US006995742B2

(12) United States Patent
Park et al.

(10) Patent No.: US 6,995,742 B2
(45) Date of Patent: Feb. 7, 2006

(54) FLAT PANEL DISPLAY DEVICE FOR SMALL MODULE APPLICATION

(75) Inventors: Jae Deok Park, Kyongsangbuk-do (KR); Seong-Gyun Kim, Kyonggi-do (KR)

(73) Assignee: LG. Philips LCD Co., Ltd., Seoul (KR)

( * ) Notice: Subject to any disclaimer, the term of this patent is extended or adjusted under 35 U.S.C. 154(b) by 380 days.

(21) Appl. No.: 10/421,692

(22) Filed: Apr. 24, 2003

(65) Prior Publication Data

US 2004/0125065 A1 Jul. 1, 2004

(30) Foreign Application Priority Data

Dec. 31, 2002 (KR) ..... 10-2002-0087754

(51) Int. Cl.
*G09G 3/36* (2006.01)

(52) U.S. Cl. ..... 345/100; 345/92; 345/98

(58) Field of Classification Search ..... 345/87, 345/90, 92, 98, 100, 204
See application file for complete search history.

(56) References Cited

U.S. PATENT DOCUMENTS

| | | | | | |
|---|---|---|---|---|---|
| 5,598,180 | A | | 1/1997 | Suzuki et al. | |
| 5,953,003 | A | * | 9/1999 | Kwon et al. | 345/204 |
| 6,157,361 | A | * | 12/2000 | Kubota et al. | 345/100 |
| 6,373,460 | B1 | * | 4/2002 | Kubota et al. | 345/100 |
| 6,388,653 | B1 | * | 5/2002 | Goto et al. | 345/98 |
| 6,392,628 | B1 | | 5/2002 | Yamazaki et al. | |
| 6,724,363 | B1 | * | 4/2004 | Satoh et al. | 345/100 |
| 2002/0080108 | A1 | | 6/2002 | Wang | |
| 2002/0167502 | A1 | * | 11/2002 | Yamazaki et al. | 345/204 |
| 2002/0196223 | A1 | * | 12/2002 | Takahashi et al. | 345/90 |
| 2003/0067434 | A1 | * | 4/2003 | Haga et al. | 345/98 |
| 2004/0055963 | A1 | * | 3/2004 | Toyozawa et al. | 210/744 |
| 2004/0196231 | A1 | * | 10/2004 | Goto et al. | 345/87 |

FOREIGN PATENT DOCUMENTS

| | | |
|---|---|---|
| DE | 43 06 988 | 9/1993 |
| EP | 0 957 491 | 11/1999 |

OTHER PUBLICATIONS 16.1: "Low–Power Integrated Circuit Technologies Using Low Temperature Poly–Si TFTs for Mobile Device Applications", Noboru Toyozawa, et al., 2002 SID International Symposium Digest of Technical Papers, vol. 33, Jun. 2002, pp 686–689, col. 1.

18.4: TFT–LCDs with Monolithic Multi–Drivers for High Performance Video and Low–Power Text Modes, Hajime Washio, et al., 2001 SID International Symposium Digest of Technical Papers, San Jose, California, Jun. 5–7, 2001, vol. 32, Jun. 2001, pp 276–279, col. 1.

* cited by examiner

*Primary Examiner*—Amare Mengistu
(74) *Attorney, Agent, or Firm*—McKenna Long & Aldridge LLP

(57) ABSTRACT

A flat panel display device for a small module application is disclosed in the present invention. The flat display device includes a DC/DC converter supplying a DC voltage, a timing controller connected to the DC/DC converter, the timing controller outputting a gate control signal and a data control signal, a first level shifter at the circuit unit amplifying the gate control signal and the data control signal for the timing controller, a second level shifter at the display panel amplifying the gate control signal and the data control signal amplified by the first level shifter, a plurality of gate lines and data lines crossing one another, a gate driver connected to a first end of each of the gate lines, the gate driver outputting a scan signal according to the gate control signal amplified by the second level shifter, and a data driver connected to a second end of each of the data lines, the data driver outputting a gray level voltage according to the data control signal amplified by the second level shifter.

42 Claims, 14 Drawing Sheets

FLAT PANEL DISPLAY DEVICE FOR SMALL MODULE APPLICATION

This application claims the benefit of the Korean Patent Application No. P2002-087754 filed on Dec. 31, 2002, which is hereby incorporated by reference.

BACKGROUND OF THE INVENTION

1. Field of the Invention

The present invention relates to a flat panel display device, and more particularly, to a flat panel display device for a small module application. Although the present invention is suitable for a wide scope of applications, it is particularly suitable for a reliable operation and small module application.

2. Discussion of the Related Art

Cathode ray tubes (CRTs) have been widely used for display devices such as a television and a monitor. However, the CRTs have some disadvantages, for example, heavy weight, large volume and high driving voltage. Accordingly, flat panel display (FPD) devices, such as liquid crystal display (LCD) devices and organic electroluminescent display (ELD) devices, having excellent characteristics of light weight and low power consumption have been the subject of recent researches.

In general, an LCD device is a non-emissive display device that displays images by a refractive index difference utilizing optical anisotropy properties of a liquid crystal material interposed between an array substrate and a color filter substrate. On the other hand, an ELD device is an emissive display device using an electroluminescent (EL) phenomenon that light is emitted from a luminescent layer when an electric field is applied. The ELD device can be classified into inorganic and organic types according to a source generating an excitation of carriers. Especially, an inorganic type ELD device has been widely used because of its capabilities of displaying full color and moving images, high brightness, and low driving voltage.

The FPD devices such as LCD devices and ELD devices have a circuit unit and a display panel. The circuit unit converts RGB (red, green, and blue) data and control signals of the external driving system into pertinent electrical signals and the display panel shows images to users by using the electrical signals.

Recently, an active matrix type display panel in which a plurality of pixels are disposed in matrix and a thin film transistor (TFT) is formed at each pixel as a switching device is widely used.

FIG. 1 is a schematic block diagram illustrating a related art active matrix display panel 10 and a circuit unit 40 connected to the display panel. In FIG. 1, a display panel 10 includes first and second substrates (not shown) facing into each other. A plurality of gate lines 14 parallel to one another and a plurality of data lines 18 parallel to one another are disposed between the first and second substrates. The plurality of gate lines 14 cross the plurality of data lines 18, thereby defining a plurality of pixel regions "P" in matrix.

FIGS. 2A and 2B are schematic diagrams illustrating a pixel region when a display panel is a liquid crystal panel for a liquid crystal display (LCD) device, and when an organic electroluminescent panel for an organic electroluminescent display (ELD) device, respectively.

As shown in FIG. 2A, each pixel region "P" includes a switching thin film transistor (TFT) "$T_S$" as a switching device, a liquid crystal capacitor "$C_{LC}$", and a storage capacitor "$C_{ST}$". The liquid crystal capacitor "$C_{LC}$" includes a pixel electrode and a common electrode facing into each other, and a liquid crystal layer interposed between the pixel electrode and the common electrode. The TFT "$T_S$" includes a gate electrode connected to the gate line 14, a drain electrode connected to the data line 18, a source electrode connected to the pixel electrode, an active layer which is a path for electrons and holes, and an ohmic contact layer. The storage capacitor "$C_{ST}$" is connected to the liquid crystal capacitor "$C_{LC}$" in parallel to resolve a parasitic capacitance problem resulting from the pixel design.

As shown in FIG. 2B, each pixel region "P" includes a switching TFT "$T_S$", a driving TFT "$T_D$", an emission diode "D", and a storage capacitor "$C_{ST}$". The emission diode "D" includes an anode and a cathode facing into each other, and an organic emission layer interposed between the anode and the cathode. The switching TFT "$T_S$" includes a gate electrode connected to a gate line 14, a drain electrode connected to a data line 18, a source electrode connected to a gate electrode of the driving TFT "$T_D$", an active layer and an ohmic contact layer. The storage capacitor "$C_{ST}$" is connected to the gate electrode and a drain electrode of the driving TFT "$T_D$".

Referring back to FIG. 1, the circuit unit processes RGB (red, green, and blue) data and control signals transmitted from the external driving system and supplies the display panel 10 with the processed RGB data and the control signals. The circuit unit 40 includes a timing controller 32, a level shifter 34, a power supply 36, a gate driver 12, and a data driver 16. When the active layer of the switching TFT "$T_S$" and the driving TFT "$T_D$" is formed of polycrystalline silicon, a portion of the circuit unit 40 can be formed in the display panel 10. The gate driver 12 is disposed at a first edge of the display panel 10 and connected to the gate lines 14. The data driver 16 is disposed at a second edge of the display panel 10 adjacent to the first edge and connected to the data lines 18.

The timing controller 32 processes the RGB data and the control signals transmitted from the external driving system and outputs gate and data control signals. The control signals include a vertical sync signal "Vsync" of a frame discrimination signal, a horizontal sync signal "Hsync" of a line discrimination signal, a data enable signal "DE" indicating a time for data input and a main clock "MCLK" as timing sync signals. The timing controller 32 rearranges the RGB data and outputs the data control signals for driving the display panel 10 according to the timing sync signals to the data driver 16. The data control signals include RGB digital data (R(0, N), G(0, N), B(0, N)), a horizontal sync signal "Hsync," a horizontal line start signal "HST" which forces to start to input the RGB data to the data driver 16 and a source pulse clock "HCLK" for a data shift in the data driver 16. Moreover, the timing controller 32 outputs the gate control signals to the gate driver 12. The gate control signals include a vertical sync signal "Vsync", a vertical line start signal "VST" which forces to start to input a gate-on-signal to the gate driver 12, and a gate clock "VCLK" for sequentially inputting the gate-on-signal to the respective gate lines 14.

The power supply 36 includes a gate driving voltage generator 36*a*, a DC/DC (direct current/direct current) converter 36*b* and a gray level voltage generator 36*c*. The gate driving voltage generator 36*a* outputs a gate-on-voltage "Von" for the gate-on-signal and a gate-off-voltage "Voff" for a gate-off-signal to the gate driver 12. The DC/DC convert 36*b* outputs a DC voltage for driving each element of the display panel 10 and the circuit unit 40. The gray level voltage generator 36*c* generates and outputs a gray level voltage to the data driver 16 according to the bit number of the RGB data and a gray level reference voltage transmitted from the external circuit.

The data driver 16 including a data shift register (not shown) generates a latch clock by shifting the horizontal sync signal "Hsync" and the horizontal line start signal "HST" with the source pulse clock "HCLK" and selects a pertinent gray level voltage by sampling the RGB digital data for each data line 16 according to the latch clock. The gate driver 12 including a gate shift register (not shown) sequentially enables the gate lines 14 by shifting the vertical sync signal "Vsync" and the vertical line start signal "VST" with the gate clock "VCLK" and outputs the gate-on-voltage "Von" and the gate-off-voltage "Voff" transmitted from the gate driving voltage generator 36*a*. Thus, each switching TFT "$T_S$" applies the gray level voltage to the liquid crystal capacitor "$C_{LC}$" or the emission diode "D" according to a scan signal including the gate-on-voltage "Von" and the gate-off-voltage "Voff".

Although not shown in FIG. 1, the data shift register and the gate shift register include a plurality of shift register TFTs formed of polycrystalline silicon. The source pulse clock "HCLK" and the gate clock "VCLK" applied to the shift register TFTs are required to have a voltage-swing greater than about 10 V. Since the shift register TFTs are formed in the display panel 10 by using polycrystalline silicon, the shift register TFTs can reliably function with a clock having a voltage-swing greater than about 10 V. However, since a clock outputted from the timing controller 32 has a voltage-swing of about 3.3 V, the circuit unit 10 includes the level shifter 34 that amplifies the clock to have a voltage-swing greater than about 10 V.

Generally, the level shifter 34 amplify a voltage-swing of about 3.3 V to a voltage-swing greater than about 10 V is composed of integrated circuit (IC) formed on a wafer (i.e., single crystalline silicon). Since a required carrier mobility cannot be obtained when the level shifter 34 is formed in the display panel 10 by using polycrystalline silicon. Moreover, even when the level shifter 34 is composed of IC, it is difficult to combine the level shifter 34 having a voltage level greater than about 10 V and the other elements into a single chip. Accordingly, an additional chip is required for the level shifter 34 and the additional chip including the level shifter 34 is formed on a printed circuit board (PCB) 40. The PCB 40 is connected to the display panel 10 through a flexible printed circuit board (F-PCB) 50.

The timing controller 32 can be formed in the display panel 10. When the timing controller 32 is formed in the display panel 10, however, a driving reliability is reduced and a circuit design becomes complex because all the clocks are outputted from the display panel 10, amplified at the level shifter 34, and inputted back to the display panel 10.

On the other hand, a multiplexer (MUX) can be formed in the display panel 10 instead of the data driver 16, as shown in FIG. 3.

FIG. 3 is a schematic block diagram illustrating another related art active matrix display panel including a multiplexer MUX and a circuit unit connected to the display panel. In FIG. 3, the same elements those of FIG. 1 are represented with the same reference numerals, and descriptions will be omitted for simplicity.

A MUX combines a plurality of data streams into one signal or vice versa. In FIG. 3, a MUX 60 has an input and output ratio of 1:3. The MUX 60 is formed in a display panel 10 instead of a data driver 16 and has a plurality of data lines 18 as output terminals. The data driver 16 at the exterior of the display panel 10 is connected to the MUX 60 through a plurality of input terminals 62. Signals outputted from a timing controller 32 include a MUX clock for driving the MUX 60. The timing controller 32, a level shifter 34, and a power supply 36 are formed on an additional printed circuit board (PCB) 40. The PCB 40 is connected to the display panel 10 through a flexible-printed circuit board (F-PCB) 50 including the data driver 16 composed of an integrated circuit (IC).

The MUX 60 in the display panel 10 includes a plurality of MUX thin film transistors (TFTs). FIG. 4 is a schematic circuit diagram illustrating the MUX of FIG. 3. FIG. 5 is a timing chart illustrating a propagation of a MUX clock of the MUX of FIG. 4 during one frame. In FIGS. 4 and 5, the plurality of MUX TFTs of the MUX 60 are formed of one type of TFT (i.e., a positive metal oxide silicon (PMOS) TFT) for convenience of descriptions.

As shown in FIGS. 4 and 5, when an input and output ratio is 1:3, one of the input terminals 62 (shown in FIG. 3) is connected to each source electrode of three MUX TFTs 64 and each drain electrode of three MUX TFTs 64 is connected to the respective data line 18. Three MUX clocks "Φ1, Φ2, and Φ3" are sequentially inputted into three gate electrodes of three MUX TFTs 64. When one of the input terminals 62 (shown in FIG. 3) outputs a first gray level voltage "Da", the first gray level voltage "Da" is transmitted into three source electrodes of three MUX TFTs "Ta-1, Ta-2, and Ta-3". First, second, and third MUX clocks "Φ1, Φ2, and Φ3" are sequentially inputted into three gate electrodes of the three MUX TFTs "Ta-1, Ta-2, and Ta-3", respectively. Moreover, three drain electrodes of the three MUX TFTs "Ta-1, Ta-2, and Ta-3" are connected to first, second, and third data lines "La-1, La-2, and La-3". Similarly, these conditions are applied to the other gray level voltages "Db and Dc" of the other input terminals.

Therefore, as shown in FIG. 5, while a scan signal is applied to an n-th gate line "Gn", the first, second, and third gray level voltages "Da, Db, and Dc" are outputted from the first, fourth, and seventh data lines "La-1, Lb-1, and Lc-1" by the first MUX clock "Φ1", respectively. Sequentially, the first, second, and third gray level voltages "Da, Db, and Dc" are respectively outputted from the second, fifth, and eighth data lines "La-2, Lb-2, and Lc-2" by the second MUX clock "Φ2", and respectively outputted from the third, sixth, and ninth data lines "La-3, Lb-3, and Lc-3" by the third MUX clock "Φ3". These operations are repeated while the scan signal is sequentially scanned from the n-th gate line "Gn" to an m-th gate line "Gm", thereby displaying an image for one frame.

The number of ICs for the data driver 16 (shown in FIG. 3) and the number of input terminals 62 (shown in FIG. 3) of the data driver 16 can be reduced by forming the MUX 60 within the display panel 10 (shown in FIG. 3). The MUX clocks "Φ1, Φ2, and Φ3" are outputted from the timing controller 32 (shown FIG. 3). Since the timing controller 32 and the data driver 16 are disposed at the exterior of the display panel 10, a plurality of signals transmitted from the timing controller 32 to the data driver 16 do not have to be amplified. Accordingly, data control signals are directly transmitted from the timing controller 32 to the data driver 16 unlike the circuit unit shown in FIG. 1.

However, since the MUX 60 including a plurality of MUX TFTs 62 of polycrystalline silicon is formed on the display panel 10, the MUX clocks transmitted to the plurality of MUX TFTs 62 are required to have a voltage-swing greater than about 10 V, for example, about 18 V. Therefore, original MUX clocks outputted from the timing controller 32 should be amplified to have a voltage-swing greater than about 10 V by the level shifter 34.

It is difficult to form the level shifter 34 on the display panel 10. And, the level shifter is generally composed of an additional IC on the PCB 50 at the exterior of the display panel 10 to have a required carrier mobility. However, this structure makes the circuit unit exterior of the display panel 10 complex and large-sized. Accordingly, it is difficult to apply such a structure to a small-sized module, such as a personal digital assistant (PDA) and a mobile phone. To apply to the small-sized module, the external circuit unit must be small-sized and simplified such that the external circuit unit can be formed in a single semiconductor chip. However, since the level shifter in the related art is formed in the additional chip, the design of the circuit unit exterior of the display panel becomes complex and the display device becomes large.

SUMMARY OF THE INVENTION

Accordingly, the present invention is directed to a flat display device for a small module application that substantially obviates one or more of problems due to limitations and disadvantages of the related art.

Another object of the present invention is to provide a flat panel display device for a small module application that operates more reliably and can be applied to a small-sized module.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a flat panel display device having a circuit unit and a display panel includes a DC/DC converter supplying a DC voltage, a timing controller connected to the DC/DC converter, the timing controller outputting a gate control signal and a data control signal, a first level shifter at the circuit unit amplifying the gate control signal and the data control signal from the timing controller, a second level shifter at the display panel amplifying the gate control signal and the data control signal amplified by the first level shifter, a plurality of gate lines and data lines crossing one another, a gate driver connected to a first end of each of the gate lines, the gate driver outputting a scan signal according to the gate control signal amplified by the second level shifter, and a data driver connected to a second end of each of the data lines, the data driver outputting a gray level voltage according to the data control signal amplified by the second level shifter.

In another aspect of the present invention, a flat panel display device having a circuit unit and a display panel includes a DC/DC converter supplying a DC voltage, a timing controller connected to the DC/DC converter, the timing controller outputting a gate control signal, a data control signal, and a multiplexer clock, a first level shifter at the circuit unit amplifying the gate control signal and the multiplexer clock from the timing controller, a data driver outputting a gray level voltage according to the data control signal, a second level shifter at the display panel amplifying the gate control signal and the multiplexer clock, a plurality of gate lines and data lines crossing one another, a gate driver connected to a first end of each of the gate lines, the gate driver outputting a scan signal according to the gate control signal amplified by the second level shifter, and a multiplexer connected to the data driver and a second end of each of the data lines, the multiplexer outputting the gray level voltage transmitted from the data driver according to the multiplexer clock amplified by the second level shifter.

In another aspect of the present invention, a gate level shifter of a flat panel display device driven by positive and negative power sources and positive and negative input multiplexer clocks includes a first switching part receiving the positive input multiplexer clock and the negative power source and outputting a first output voltage, a second switching part receiving the negative input multiplexer clock and the positive power source and outputting a second output voltage, a third switching part receiving the first output voltage and outputting a third output voltage, and a fourth switching part receiving the third output voltage and outputting a fourth output voltage substantially the same as the negative power source, wherein an absolute value of the third output voltage is greater than that of the fourth output voltage.

In a further aspect of the present invention, a method of driving a gate level shifter of a flat panel display device driven by positive and negative power sources and positive and negative input multiplexer clocks includes receiving the positive input multiplexer clock at a first switching part and the negative power source to output a first output voltage, receiving the negative input multiplexer clock and the positive power source at a second switching part to output a second output voltage, receiving the first output voltage at a third switching part to output a third output voltage, and outputting a fourth output voltage substantially the same as the negative power source at a fourth switching part after receiving the third output voltage, wherein an absolute value of the third output voltage is greater than that of the fourth output voltage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

A flat panel display (FPD) device according to the present invention includes a first level shifter firstly amplifying a clock outputted from a timing controller and a second level shifter secondly amplifying the clock amplified by the first level shifter. The first level shifter is disposed at the exterior of a display panel and the second level shifter is formed in the display panel. Moreover, since the first level shifter and the timing controller can be formed in a single chip, the flat panel display panel can be used in a small-sized module.

Figure 1:
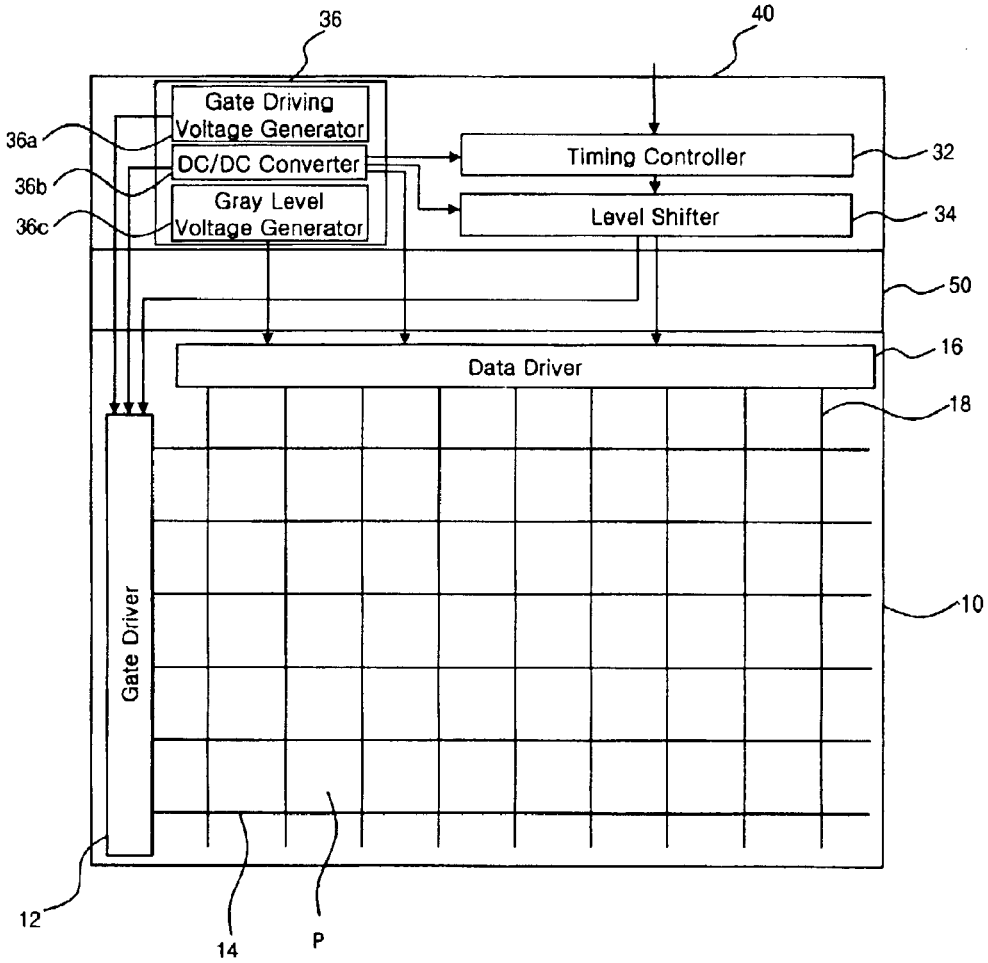
FIG. 1 Related Art
FIG. 1 is a schematic block diagram illustrating a related art flat panel display device having an active matrix display panel and a circuit unit.
Figure 2A:
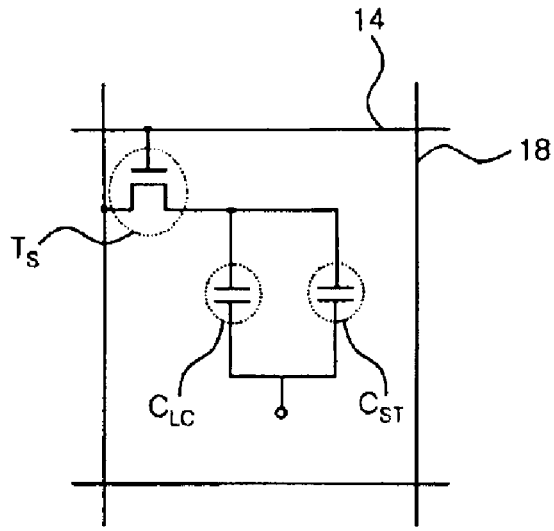
FIG. 2A Related Art
FIG. 2A is a schematic diagram illustrating a pixel region in case that a display panel is for a liquid crystal display (LCD) device.
Figure 2B:
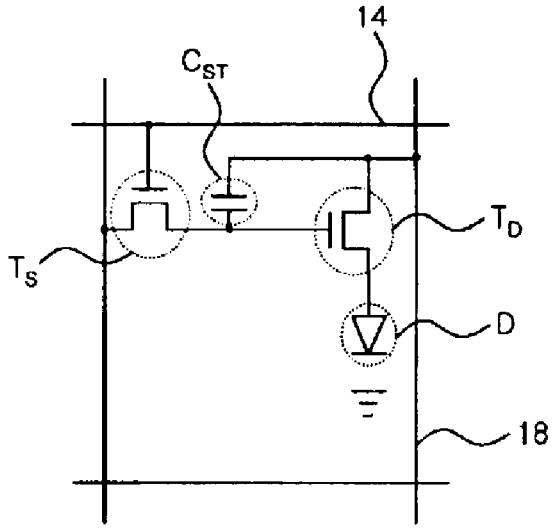
FIG. 2B Related Art
FIG. 2B is a schematic diagram illustrating a pixel region in case that a display panel is for an organic electroluminescent display (ELD) device.
Figure 3:
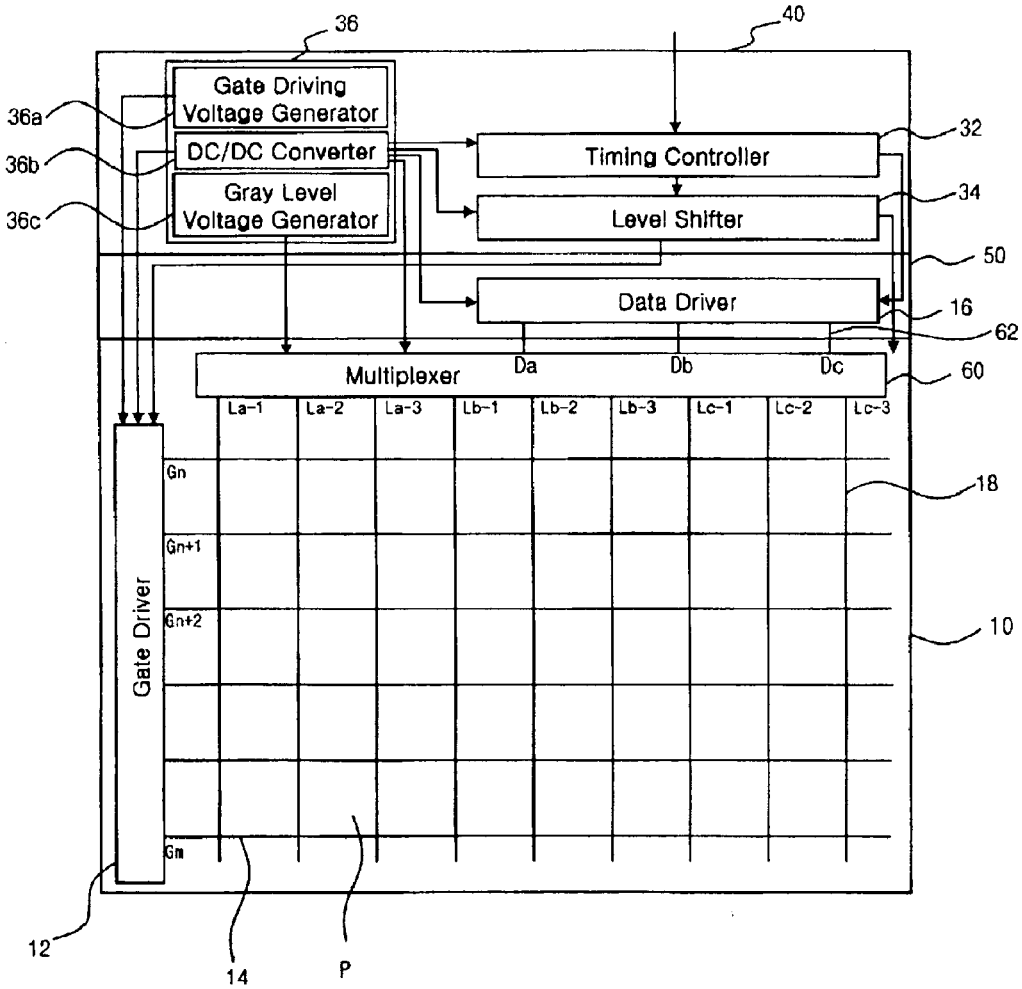
FIG. 3 Related Art
FIG. 3 is a schematic block diagram illustrating another related art flat panel display device having an active matrix display panel including a MUX and a circuit unit.
Figure 4:
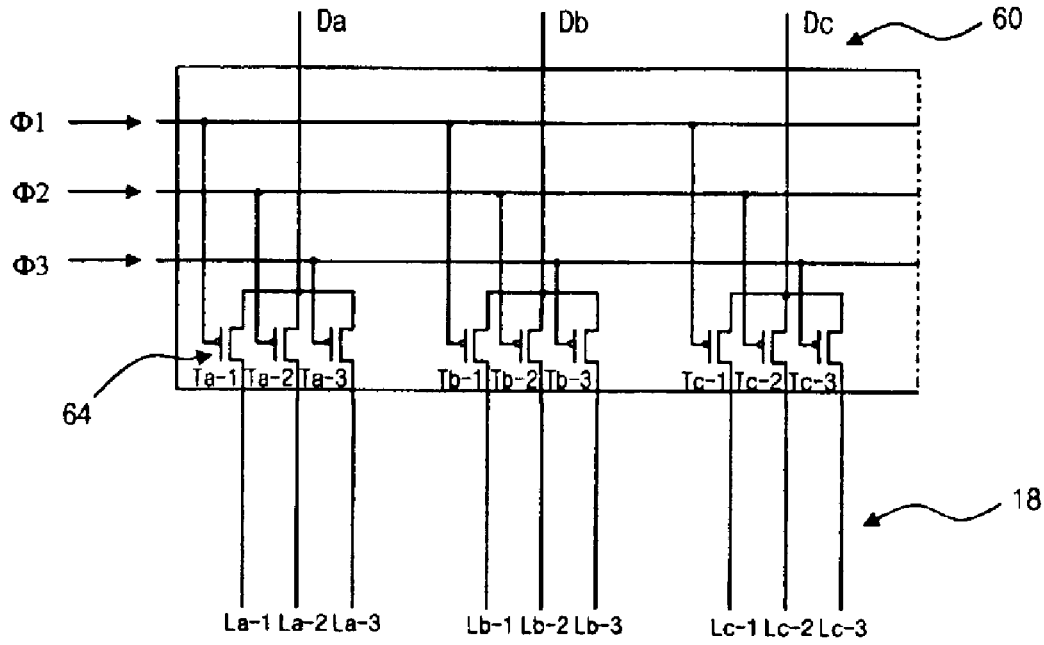
FIG. 4 Related Art
FIG. 4 is a schematic circuit diagram illustrating the MUX of FIG. 3.
Figure 5:
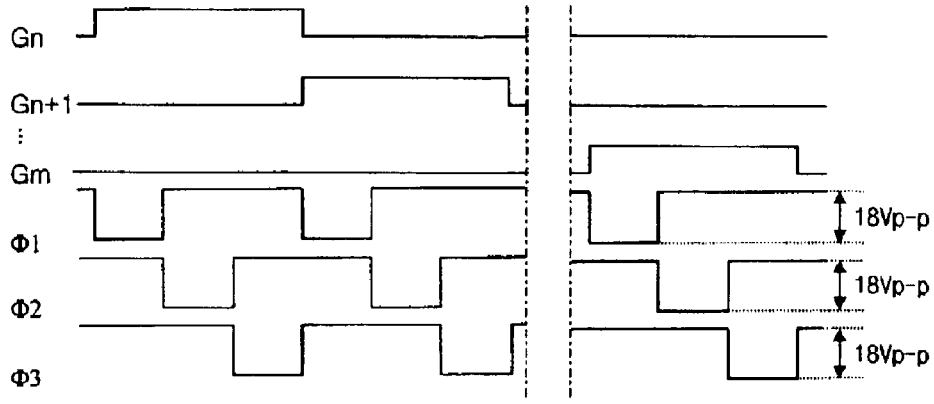
FIG. 5 is a timing chart illustrating a propagation of a MUX clock of the MUX of FIG. 4 during one frame.
Figure 6:
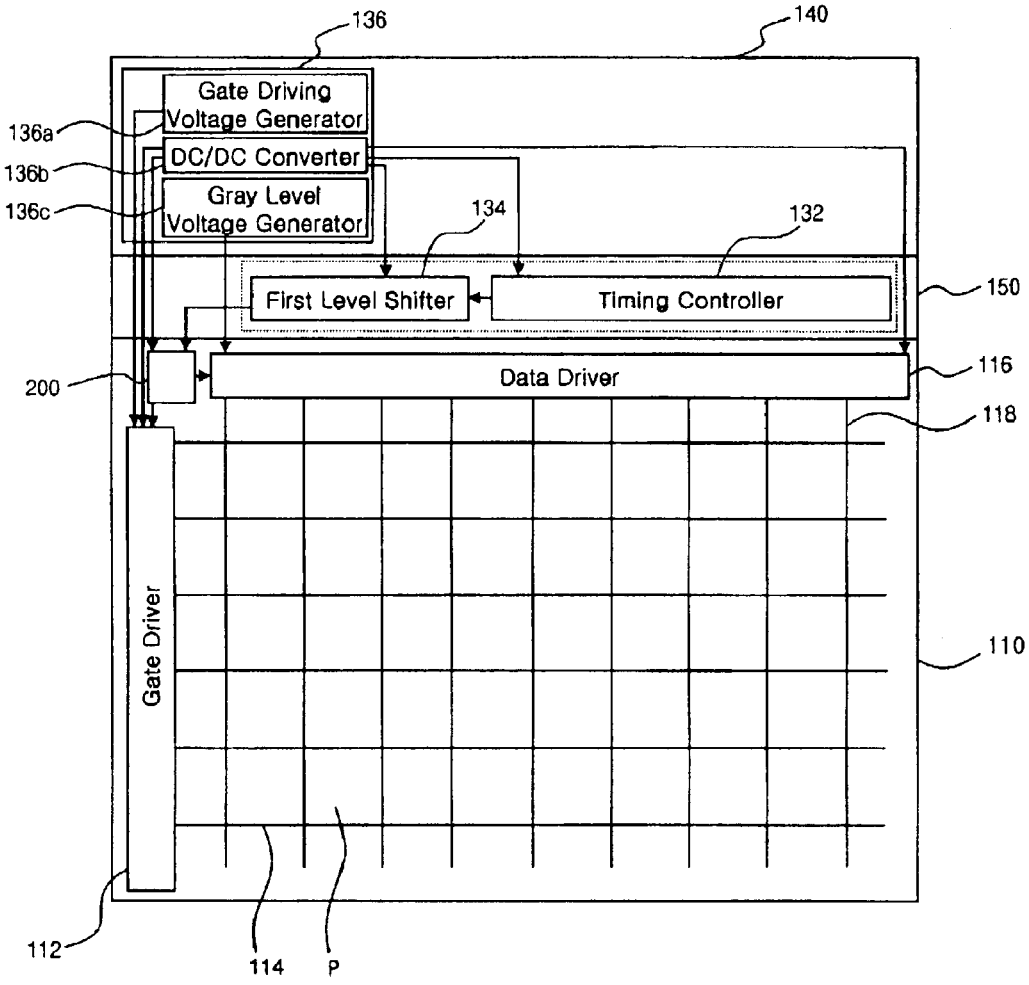
FIG. 6 is a schematic block diagram of a flat panel display device according to a first embodiment of the present invention.

FIG. 6 is a schematic block diagram of a flat panel display device according to a first embodiment of the present invention.

In FIG. 6, a display panel 110 includes first and second substrates (not shown) facing into each other. A plurality of gate lines 114 parallel to one another and a plurality of data lines 118 parallel to one another are disposed between the first and second substrates. The plurality of gate lines 114 cross the plurality of data lines 118, thereby defining a plurality of pixel regions "P" in matrix.

Figure 7A:
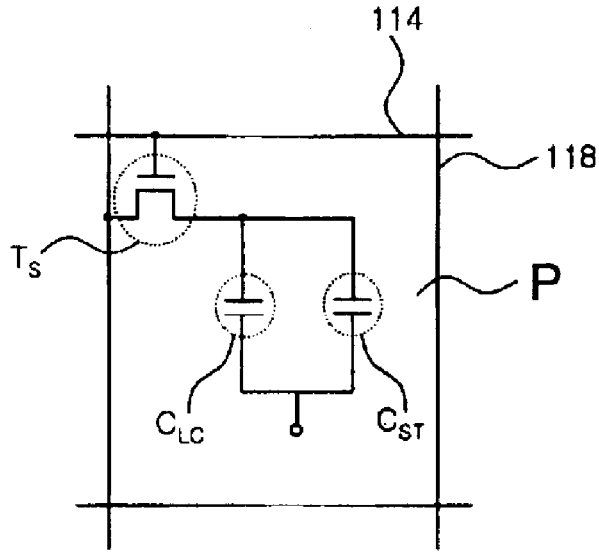
FIG. 7A is a schematic diagram illustrating a pixel region in case where a display panel is a liquid crystal panel for a liquid crystal display (LCD) device.
Figure 7B:
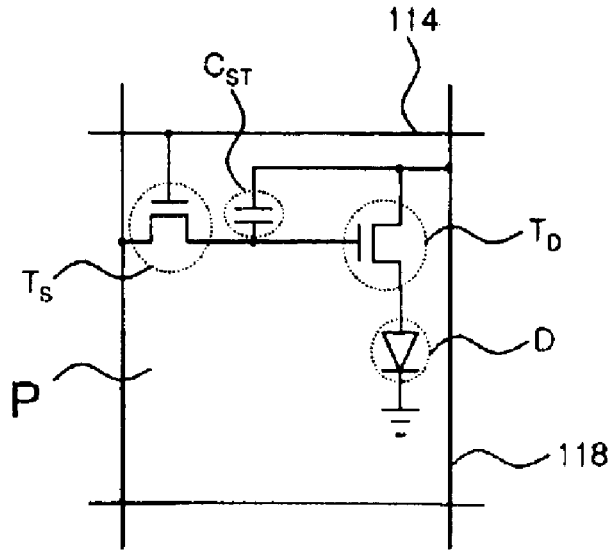
FIG. 7B is a schematic diagram illustrating a pixel region in case where a display panel is an organic electroluminescent panel for an organic electroluminescent display (ELD) device.

FIGS. 7A and 7B are schematic diagrams illustrating a pixel region in case where a display panel is a liquid crystal panel for a liquid crystal display (LCD) device, and when an organic electroluminescent panel for an organic electroluminescent display (ELD) device, respectively.

As shown in FIG. 7A, the display panel 110 is a liquid crystal panel for an LCD device, and each pixel region "P" includes a switching thin film transistor (TFT) "$T_S$", a liquid crystal capacitor "$C_{LC}$", and a storage capacitor "$C_{ST}$". The liquid crystal capacitor "$C_{LC}$" includes a pixel electrode and a common electrode facing into each other, and a liquid crystal layer interposed between the pixel electrode and the common electrode. The switching TFT "$T_S$" includes a gate electrode connected to the gate line 114, a drain electrode connected to the data line 118, a source electrode connected to the pixel electrode, an active layer which is a path for electrons and holes, and an ohmic contact layer. The storage capacitor "$C_{ST}$" is connected to the liquid crystal capacitor "$C_{LC}$" in parallel to resolve a parasitic capacitance problem resulting from the pixel design.

As shown in FIG. 7B, the display panel is an organic electroluminescent panel for an organic ELD device, and each pixel region "P" includes a switching TFT "$T_S$", a driving TFT "$T_D$", an emission diode "D", and a storage capacitor "$C_{ST}$". The emission diode "D" includes an anode and a cathode facing into each other, and an organic emission layer interposed between the anode and the cathode. The switching TFT "$T_S$" includes a gate electrode connected to the gate line 114, a drain electrode connected to the data line 118, a source electrode connected to a gate electrode of the driving TFT "$T_D$", an active layer, and an ohmic contact layer. The storage capacitor "$C_{ST}$" is connected to the gate electrode and a drain electrode of the driving TFT "$T_D$".

Referring back to FIG. 6, a gate driver 112 is connected to one end of the plurality of gate lines and disposed at a first peripheral portion of the display panel 110. The gate driver 112 sequentially outputs a scan signal turning on the switching TFT "$T_S$" to each gate line 114. A data driver 116 is connected to one end of the plurality of data lines 118 and disposed at a peripheral portion of the display panel 110 adjacent to the first peripheral portion. The data driver 116 outputs a gray level voltage. Accordingly, the switching TFT "$T_S$" functions as a switch such that the switching TFT "$T_S$" is turned on/off according to the scan signal and applies the gray level voltage to the liquid crystal capacitor "$C_{LC}$" or the emission diode "D".

The flat panel display device includes a timing controller 132 and a power supply 136. The timing controller 132 processes RGB data and control signals transmitted from the external system and outputs gate and data control signals for driving the display panel 110. The gate control signals include a vertical sync signal "Vsync" of a frame discrimination signal, a horizontal sync signal "Hsync" of a line discrimination signal, a data enable signal "DE" indicating a data input time and a main clock "MCLK" as timing sync signals. The timing controller 132 rearranges the RGB data and outputs the data control signals for driving the display panel 110 to the data driver 116 according to the timing sync signals. The data control signals include RGB digital data (R(0, N), G(0, N), B(0, N)), a horizontal sync signal "Hsync", a horizontal line start signal "HST" which forces to start to input the RGB data to the data driver 116 and a source pulse clock "HCLK" for a data shift in the data driver 116. Moreover, the timing controller 132 outputs the gate control signals to the gate driver 112. The gate control signals include a vertical sync signal "Vsync", a vertical line start signal "VST" which forces to start to input of gate-on-signals to the gated river 112 and a gate clock "VCLK" for sequentially inputting the gate-on-signals to the respective gate lines 114.

The power supply 136 includes a gate driving voltage generator 136*a*, a DC/DC (direct current/direct current) converter 136*b*, and a gray level voltage generator 136*c*. The gate driving voltage generator 136*a* outputs a gate-on-voltage "Von" for generating the gate-on-signals and a gate-off-voltage "Voff" for generating the gate-off-signals to the gate driver 112. The DC/DC convert 136*b* outputs DC voltages for driving each element of the display panel 110 and the circuit unit. The gray level voltage generator 136*c* generates and outputs a gray level voltage to the data driver 116 according to the bit number of the RGB data and a gray level reference voltage transmitted from the external system.

The data driver 116 including a data shift register (not shown) generates a latch clock by shifting the horizontal sync signal "Hsync" and the horizontal line start signal "HST" with the source pulse clock "HCLK" and selects a pertinent gray level voltage by sampling the RGB digital data for each data line 116 according to the latch clock. The gate driver 112 including a gate shift register (not shown) sequentially enables the plurality of gate lines 114 by shifting the vertical sync signal "Vsync" and the vertical line start signal "VST" with the gate clock "VCLK", and outputs the gate-on-voltage "Von" and the gate-off-voltage "Voff" transmitted from the gate driving voltage generator 136*a*.

The gate driver 112 and the data driver 116 are formed in the display panel 110. The gate and data shift registers of the gate driver 112 and the data driver 116 include a plurality of shift register TFTs formed of polycrystalline silicon. To reliably drive the plurality of shift register TFTs, the gate clock "VCLK" and the source pulse clock "HCLK" applied to the plurality of shift register TFTs are required to have a voltage-swing greater than about 10 V. However, a clock outputted from the timing controller 132 has a voltage-swing of about 3.3 V. Therefore, first and second level shifters 134 and 200 are provided to the flat panel display device in order to resolve such a problem. The first level shifter 134 is disposed at the exterior of the display panel 110 as a form of a semiconductor chip, while the second level shifter 200 including a plurality of polycrystalline silicon TFTs is disposed at the display panel 110. The gate clock "VCLK" and the source pulse clock "HCLK" outputted from the timing controller 132 are firstly amplified at the first level shifter 134 to have a first voltage-swing less than about 10 V. The gate clock "VCLK" and the source pulse clock "HCLK" amplified by the first level shifter 134 are amplified at the second level shifter 200 to have a second voltage-swing greater than about 10 V. Thus, the gate clock "VCLK" and the source pulse clock "HCLK" amplified by the second level shifter 200 are outputted to the gate driver 112 and the data driver 116, respectively. The second level shifter 200 includes a gate level shifter (not shown) amplifying the gate clock "VCLK" and a data level shifter (not shown) amplifying the source pulse clock "HCLK".

The power supply 136 including the DC/DC converter 136*b* is formed on a printed circuit board (PCB) 140 and a single semiconductor chip including the first level shifter 134 and the timing controller 132 is formed on a flexible printed circuit board (F-PCB) 150 connecting the PCB 140 and the display panel 110. The display panel 110 includes the gate driver 112, the data driver 116 and the second level shifter 200.

Since the first level shifter 134 shifts a voltage-swing of about 3.3 V to less than about 10 V, the first level shifter 134 and the timing controller 132 can be formed in a single semiconductor chip without causing a design problem. Moreover, the second level shifter 200 can be simultaneously formed in the display panel during a fabrication process of the display panel 110. Accordingly, the circuit unit at the exterior of the display panel 110 can be simplified.

The flat panel display device according to the present invention can be applied to a structure in which a multiplexer (MUX) is formed in a display panel.

Figure 8:
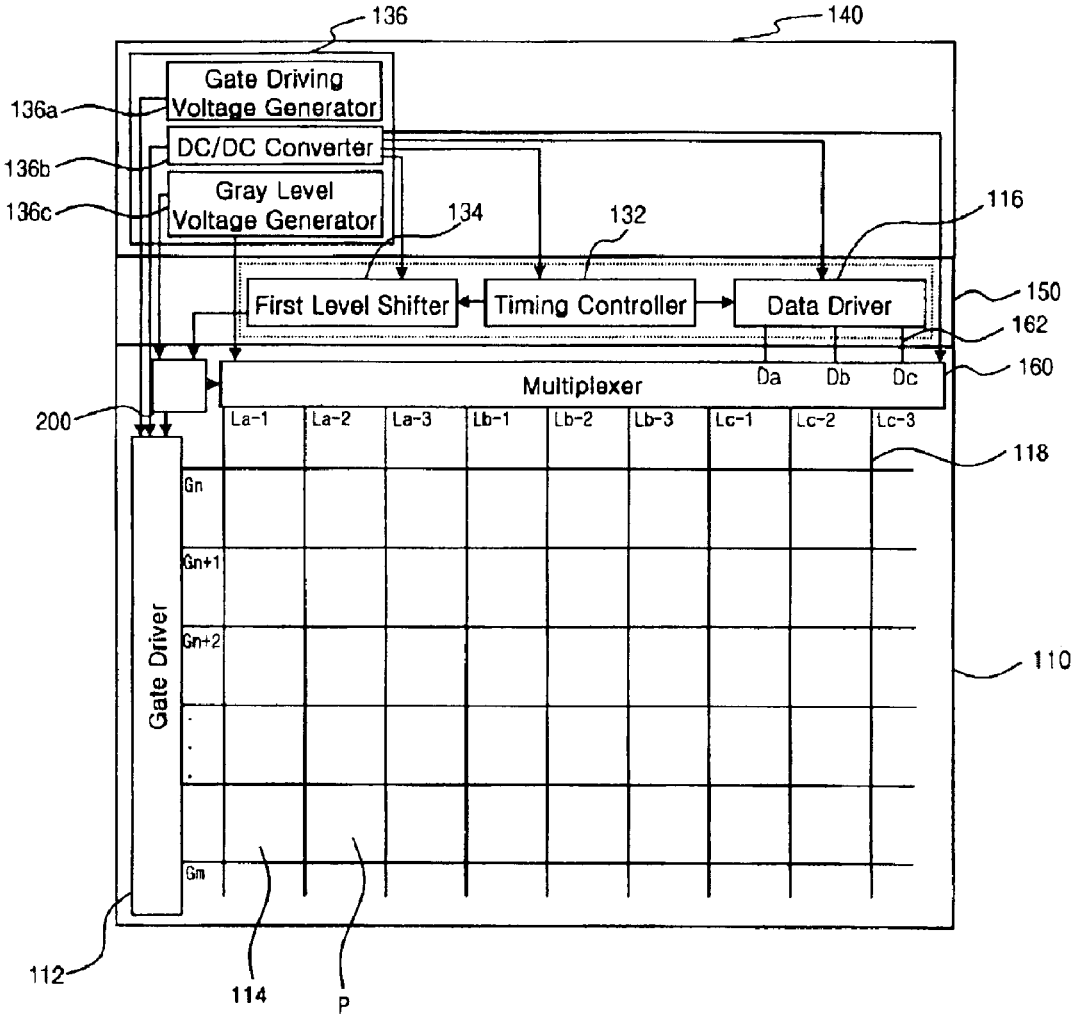
FIG. 8 is a schematic block diagram of a flat panel display device according to a second embodiment of the present invention.

FIG. 8 is a schematic block diagram of a flat panel display device according to a second embodiment of the present invention. In FIG. 8, elements having the same functions as those of FIG. 6 are designated as the same numerals, and descriptions for the elements will be omitted for simplicity.

In FIG. 8, a multiplexer (MUX) 160 connected to one end of a plurality of data lines 118 is formed in a display panel 110. The data driver 116 is disposed at the exterior of the display panel 110 and connected to the multiplexer 160 through a plurality of input terminals 162. A power supply 136 including a DC/DC converter 136*b* is formed on a printed circuit board (PCB) 140. A timing controller 132, a first level shifter 134, and the data driver 116 are formed on a flexible printed circuit board (F-PCB) 150 connecting the PCB 140 and the display panel 110. Since the timing controller 132 and the data driver 116 are disposed at the exterior of the display panel 110, it is not necessary to amplify signals transmitted from the timing controller 132 to the data driver 116. Accordingly, the timing controller 132 directly outputs the signals to the data driver 116.

The timing controller 132 also outputs a clock having a voltage-swing of about 3.3 V for driving the multiplexer 160. The clock and a gate clock "VCLK" are amplified to have a voltage-swing greater than about 10 V by the first and second level shifter 134 and 200, and transmitted to the multiplexer 160 and the gate driver 112, respectively. The second level shifter 200 includes a gate level shifter (not shown) amplifying the gate clock "VCLK" and a multiplexer level shifter (not shown) amplifying the clock. Since the gate level shifter and the multiplexer level shifter have an identical structure except for an input clock, descriptions for the multiplexer level shifter are the same as those for the gate level shifter. Moreover, the descriptions for the multiplexer level shifter are the same as those for the gate level shifter and the data level shifter of the second level shifter 200 of FIG. 6.

The second level shifter outputs an output clock having the same waveform as one of input clocks by using first and second DC voltages and a pair of clocks. The first and second DC voltages have a voltage difference greater than about 10 V and are transmitted from the DC/DC converter 136*b*. The pair of clocks have waveforms inverse to each other. The output clock has a voltage-swing greater than about 10 V.

Figure 9:
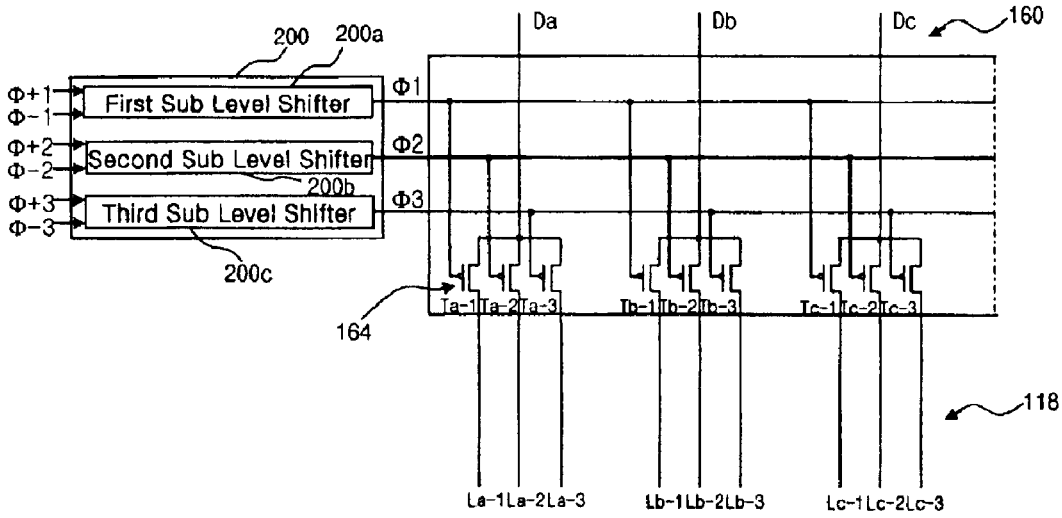
FIG. 9 is a schematic block diagram illustrating a second level shifter and a multiplexer of FIG. 8.
Figure 10:
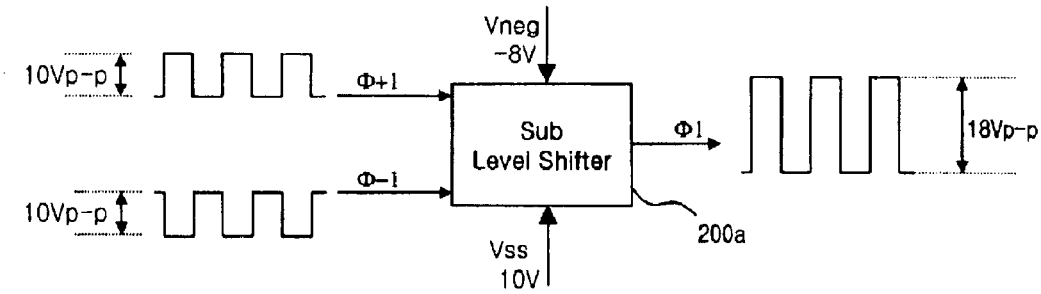
FIG. 10 is a schematic view illustrating an input clock and an output pulse of one sub-level shifter of the second level shifter of the present invention.
Figure 11:
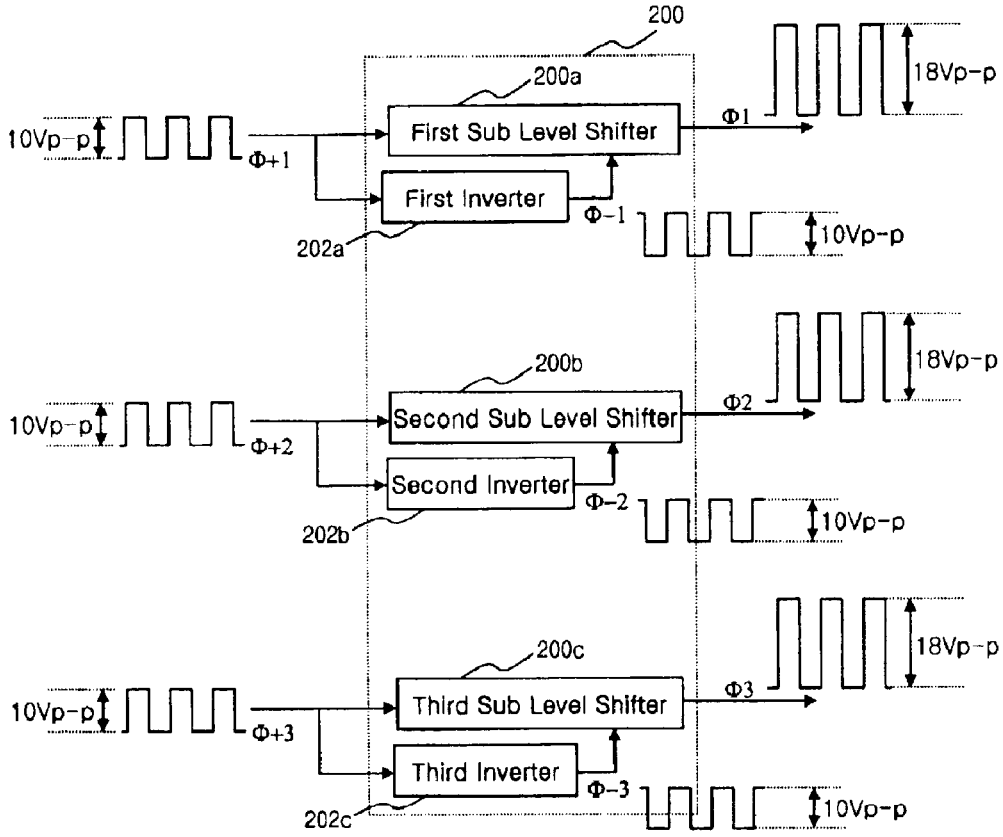
FIG. 11 is a schematic block diagram illustrating a second level shifter according to another embodiment of the present invention.

FIG. 9 is a schematic block diagram illustrating a second level shifter 200 and a multiplexer 160 of FIG. 8. FIG. 10 is a schematic view illustrating an input clock and an output pulse of one sub-level shifter applicable to both the first and second embodiments. FIG. 11 is a schematic block diagram illustrating a second level shifter 200 applicable to both the first and second embodiments of the present invention. The multiplexer may be composed of a plurality of multiplexer thin film transistors (TFTs). The plurality of multiplexer TFTs may be either n-type or p-type.

Referring back to FIGS. 8 to 10, clocks outputted from a timing controller 132 are firstly amplified to be positive and negative input multiplexer clocks having a first voltage-swing less than about 10 V by a first level shifter 134 and the positive and negative input multiplexer clocks are secondly amplified to be an output multiplexer clock having a second voltage-swing greater than about 10 V by a second level shifter 200. The positive input multiplexer clock amplified by the first level shifter 134 is designated as "Φ+n" and the output multiplexer clock amplified by the second level shifter 200 is designated as "Φn". The positive and negative input multiplexer clocks having an identical voltage-swing and an inverse waveform are designated as "Φ+n" and "Φ−n", respectively. The first and second voltage-swings are designated as 10 Vp-p and 18 Vp-p, respectively.

When a multiplexer 160 has an input/output ratio of 1:3, the number of the multiplexer TFTs 164 can be three times as many as that of input terminals 162. Accordingly, one input terminal 162 is connected to three source electrodes of three multiplexer TFTs "Ta-1", "Ta-2", and "Ta-3", and one gray level voltage "Da" outputted from one input terminal 162 is inputted to the three source electrodes of the three multiplexer TFTs "Ta-1", "Ta-2", and "Ta-3". Three drain electrodes of the three multiplexer TFTs "Ta-1", "Ta-2", and "Ta-3" are connected to three data lines "La-1", "La-2", and "La-3", respectively. Output multiplexer clocks "Φ1", "Φ2", and "Φ3" are sequentially inputted to respective three gate electrodes of the three multiplexer TFTs "Ta-1", "Ta-2", and "Ta-3". The same conditions are repeated for the gray level voltages "Da", "Db", and "Dc" outputted from the input terminals 162. When a scan signal is applied to a gate line "Gn", the gray level voltages "Da", "Db", and "Dc" are inputted to the data lines "La-1", "Lb-1", and "Lc-1" according to the first output multiplexer clock "Φ1", respectively. Similarly, the gray level voltages "Da", "Db", and "Dc" are inputted to the data lines "La-2", "Lb-2", and "Lc-2" according to the second output multiplexer clock "Φ2", and the gray level voltages "Da", "Db", and "Dc" are inputted to the data lines "La-3", "Lb-3", and "Lc-3" according to the third output multiplexer clock "Φ3", respectively.

The positive and negative input multiplexer clocks "Φ±n" amplified by the first level shifter 134 have the first voltage-swing smaller than about 10 V and the output multiplexer clock "Φn" amplified by the second level shifter 200 has the second voltage-swing greater than about 10 V, for example, about 18 V. The second level shifter 200 includes first, second, and third sub-level shifters 200*a*, 200*b*, and 200*c*. The first sub-level shifter 200*a* amplifies the positive and negative input multiplexer clocks "Φ±1" and outputs the output multiplexer clock "Φ1" having the second voltage-swing. Similarly, the second sub-level shifter 200*b* amplifies the positive and negative input multiplexer clocks "Φ±2" and outputs the output multiplexer clock "Φ2" having the second voltage-swing, and the third sub-level shifter 200*c* amplifies the positive and negative input multiplexer clocks "Φ±3" and outputs the output multiplexer clock "Φ3" having the second voltage-swing.

In this embodiment, the input/output ratio is 1:3 and the number of output multiplexer clocks is three. Alternatively, the number of sub-level shifters can be proportional to the number of output multiplexer clocks according to the capacity of the multiplexer.

The positive and negative input multiplexer clocks "Φ±n" that is amplified by the first level shifter 134, and inputted to the second level shifter 200 are a pair of signals having an identical voltage-swing and an inverse waveform. A pair of clocks may be outputted from the timing controller 132 and then amplified by the first level shifter 134 to be the positive and negative input multiplexer clocks "Φ±n". Otherwise, only one clock may be outputted from the timing controller 132 and then amplified by the first level shifter 134 to be the positive input multiplexer clock "Φ+n". The positive input multiplexer clock "Φ+n" is inverted to the negative input multiplexer clock "Φ−n" by an inverter and then inputted to the second level shifter 200. For this operation, as shown in FIG. 11, first, second, and third inverters 202*a*, 202*b*, and 202*c* may be included in the first, second, and third sub-level shifters 200*a*, 200*b*, and 200*c*, respectively.

Figure 12:
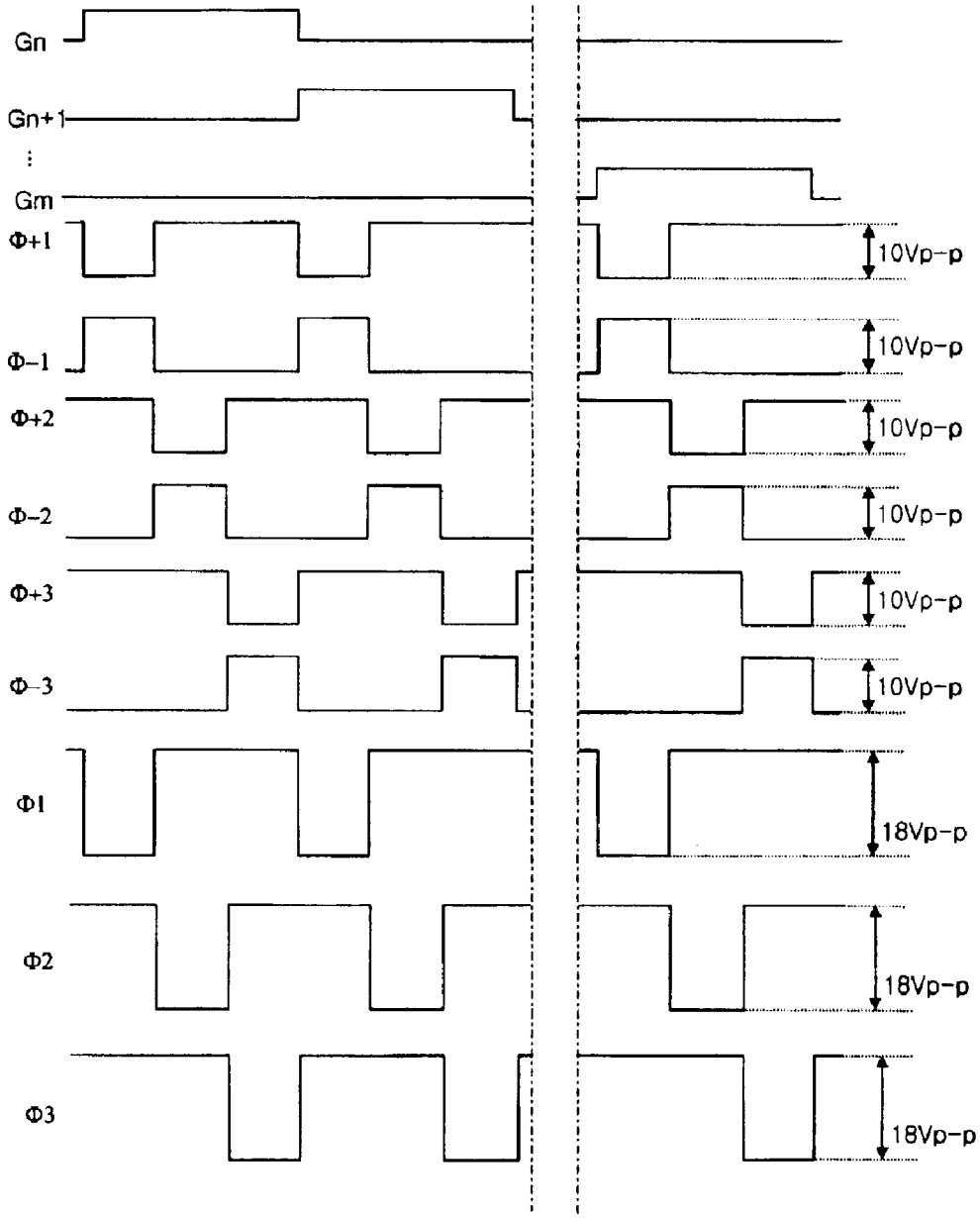
FIG. 12 is a schematic timing chart illustrating input and output multiplexer clocks during one frame according to the second embodiment of FIG. 8.

FIG. 12 is a schematic timing chart illustrating input and output multiplexer clocks during one frame according to the second embodiment of the present invention. As shown in FIGS. 8, 9, and 12, when a scan signal is outputted to each gate line "Gn" to "Gm", output multiplexer clocks "Φ1", "Φ2", and "Φ3" are sequentially outputted from first, second, and third sub-level shifters 200*a*, 200*b*, and 200*c*, respectively. The output multiplexer clocks "Φ1", "Φ2", and "Φ3" having a voltage-swing of about 18 V are generated by using positive and negative input multiplexer clocks "Φ±1", "Φ±2", and "Φ±3", respectively. One unit frame is completed after one set of scan signals is sequentially outputted to the gate lines "Gn" to "Gm".

Figure 13:
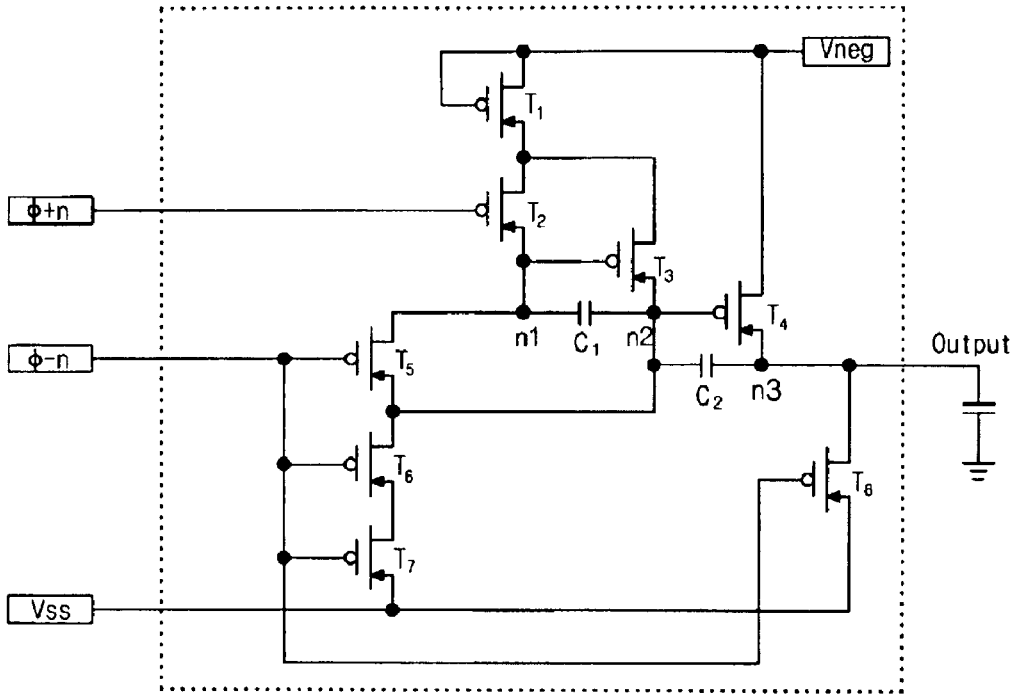
FIG. 13 is a schematic circuit diagram illustrating one sub-level shifter of a second level shifter applicable to both first and second embodiments of the present invention.

FIG. 13 is a schematic circuit diagram illustrating one sub-level shifter of a second level shifter applicable to both first and second embodiments of the present invention. For example, the sub-level shifter is composed of p-type multiplexer TFTs.

In FIG. 13, the sub-level shifter is driven by a first DC voltage "Vss", a second DC voltage "Vneg", and a pair of positive and negative input multiplexer clocks "Φ±n". The first and second DC voltages "Vss" and "Vneg" are transmitted from the power supply 136 (shown in FIG. 8). When the multiplexer 160 (shown in FIG. 8) has an input/output ratio of 1:3, the sub-level shifter includes first to eighth thin film transistors (TFTs) "$T_1$" to "$T_8$", and first and second capacitors "$C_1$" and "$C_2$". The first and second DC voltages "Vss" and "Vneg" have a voltage difference greater than about 10 V. For example, the first and second DC voltages "Vss" and "Vneg" have about 10 V and about −8 V, respectively.

The sub-level shifter driven by positive and negative power sources and positive and negative input multiplexer clocks may include a first switching part receiving the positive input multiplexer clock and the negative power source and outputting a first output voltage, a second switching part receiving the negative input multiplexer clock and the positive power source and outputting a second output voltage, a third switching part receiving the first output voltage and outputting a third output voltage, and a fourth switching part receiving the third output voltage and outputting a fourth output voltage substantially the same as the negative power source. An absolute value of the third output voltage is greater than that of the fourth output voltage.

The above-described four switching parts may be composed of TFTs and capacitors, as shown in FIG. 13. Each TFT has a gate electrode, a source electrode and a drain electrode. A first gate electrode and a drain electrode of the first TFT "$T_1$" is connected to the second DC voltage "Vneg". A second drain electrode of the second TFT "$T_2$" is connected to a first source electrode of the first TFT "$T_1$", and the positive input multiplexer clock "Φ+n" is applied to a second gate electrode of the second TFT "$T_2$". A third gate electrode of the third TFT "$T_3$" is connected to a second source electrode of the second TFT "$T_2$" through a first node "$n_1$", and a third drain electrode of the third TFT "$T_3$" is connected to the first source electrode of the first TFT "$T_1$" and the second drain electrode of the second TFT "$T_2$". A fourth gate electrode of the fourth TFT "$T_4$" is connected to a third source electrode of the third TFT "$T_3$" through a second node "$n_2$", and the second DC voltage "Vneg" is applied to a fourth drain electrode of the four TFT "$T_4$". A fifth drain electrode of the fifth TFT "$T_5$" is connected to the first node "$n_1$,", and the negative input multiplexer clock "Φ−n" is applied to a fifth gate electrode of the fifth TFT "$T_5$". A sixth drain electrode of the sixth TFT "$T_6$" is connected to a fifth source electrode of the fifth TFT "$T_5$", and the negative input multiplexer clock "Φ−n" is applied to a sixth gate electrode of the sixth TFT "$T_6$". A seventh drain electrode of the seventh TFT "$T_7$" is connected to a sixth source electrode of the sixth TFT "$T_6$". The negative input multiplexer clock "Φ−n" and the first DC voltage "Vss" are applied to seventh gate and source electrodes of the seventh TFT "$T_7$", respectively. An eighth source electrode of the eighth TFT "$T_8$" is connected to the seventh source electrode of the seventh TFT "$T_7$", and an eighth drain electrode of the eighth TFT "$T_8$" is connected to the fourth source electrode of the fourth TFT "$T_4$" through a third node "$n_3$". The negative input multiplexer clock "Φ−n" and the first DC voltage "Vss" are applied to eighth gate and source electrodes of the eighth TFT "$T_8$", respectively. A first capacitor "$C_1$" is disposed between the first and second nodes "$n_1$" and "$n_2$", and a second capacitor "$C_2$" is disposed between the second and third nodes "$n_2$" and "$n_3$". The third node "$n_3$" functions as an output terminal of the sub-level shifter. The first to eighth TFTs "$T_1$" to "$T_8$" are p-type and have a threshold voltage of about −3 V.

The first and second DC voltages are about 10 V and about −8 V, respectively. The positive and negative input multiplexer clocks "Φ+n" and "Φ−n" have a voltage-swing of about 10 V and a waveform opposite to each other. Accordingly, the negative input multiplexer clock "Φ−n" becomes high when the positive input multiplexer clock "Φ+n" becomes low and vice versa. When the positive input multiplexer clock "Φ+n" is low and the negative input multiplexer clock "Φ−n" is high, the first and second TFTs "$T_1$" and "$T_2$" are turned on and the fifth to eighth TFTs "$T_5$" to "$T_8$" are turned off. Thus, an electrical potential of the first node "$n_1$," becomes about −8 V. Accordingly, the third TFT "$T_3$" is turned on and an electrical potential of the second node "$n_2$" becomes about −8 V. Finally, the fourth TFT "$T_4$" is turned on and the third node "$n_3$" functioning as an output terminal of the sub-level shifter outputs an electrical potential of about −8 V. Although the electrical potential of the first node "$n_1$" somewhat rises because of the threshold voltages of the first and second TFTs "$T_1$" and "$T_2$", the electrical potential of the second node "$n_2$" is compensated through bootstrapping by a ratio of the first capacitor "$C_1$" to the second capacitor "$C_2$" so that the fourth TFT "$T_4$" can be turned on. Sequentially, when the positive input multiplexer clock "Φ+n" is high and the negative input multiplexer clock "Φ−n" is low, the second TFT "$T_2$" is turned off and the fifth to seventh TFTs "$T_5$" to "$T_7$" are turned off. Thus, an electrical potential of the first node "$n_1$" becomes about 10 V. Accordingly, the third TFT "$T_3$" is turned off and an electrical potential of the second node "$n_2$" becomes about 10 V. Finally, the fourth TFT "$T_4$" is turned on and the third node "$n_3$" functioning as an output terminal of the sub-level shifter outputs an electrical potential of about 10 V. Therefore, an output multiplexer clock "Φn" that has the same waveform as the positive input multiplexer clock "Φ+n" and a voltage-swing of about 18 V is outputted from the sub-level shifter.

The circuit diagram of FIG. 13 is also applicable to the first to third sub-level shifters 200*a* to 200*c* of the second level shifter 200. Moreover, the level shifters and the multiplexer may be composed of n-type TFTs with clocks having an inverse waveform.

Figure 14A:
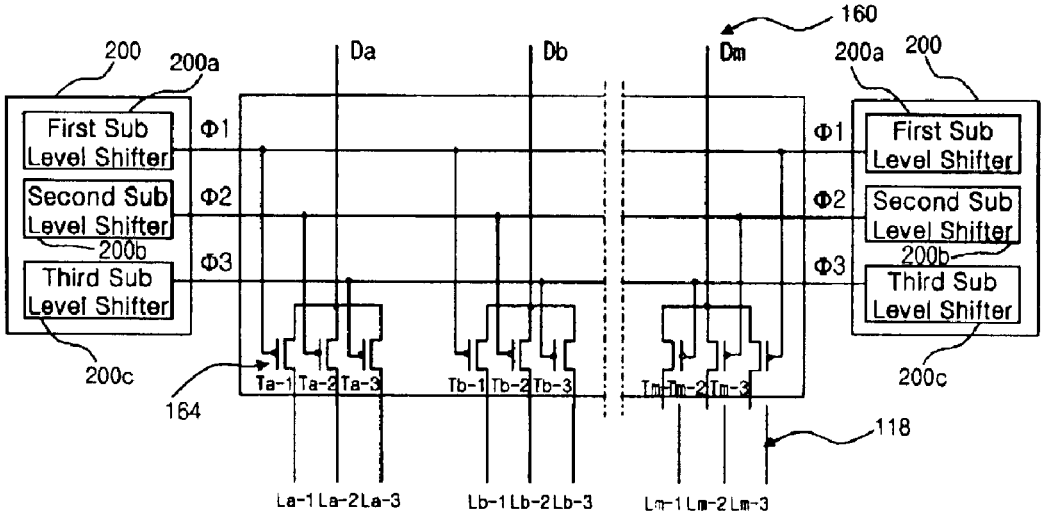
FIGS. 14A and 14B are schematic block diagrams illustrating other configurations of a second level shifter and a multiplexer according to the second embodiment of the present invention.
Figure 14B:
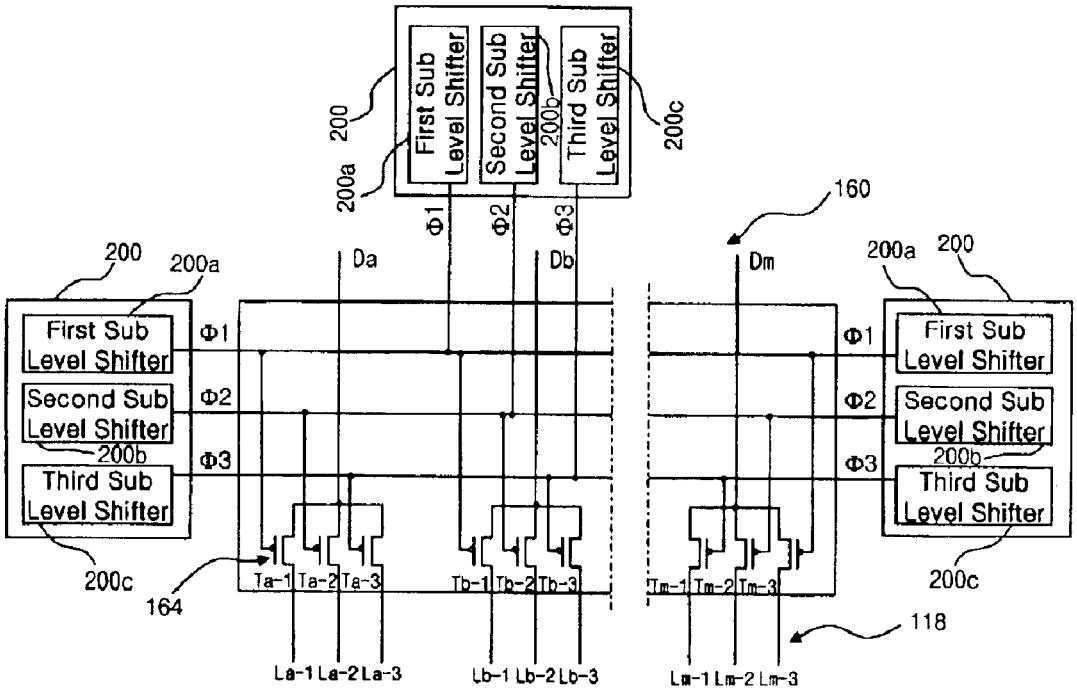

FIGS. 14A and 14B are schematic block diagrams illustrating other configurations of a second level shifter and a multiplexer according to the second embodiment of the present invention. In FIGS. 14A and 14B, when a load of a multiplexer 160 is high, output multiplexer clocks having a voltage-swing of about 18 V can be supplied from two or three second level shifters 200.

Consequently, a flat panel display device includes a first level shifter at the exterior of a display panel and a second level shifter at the display panel. The first level shifter amplifies a clock to an input multiplexer clock having a voltage-swing less than about 10 V and the second level shifter amplifies the input multiplexer clock to an output multiplexer clock having a voltage-swing greater than about 10 V. Since the first level shifter is formed in a single semiconductor chip with a timing controller and the other circuits, a flat panel display device can be applied to a small-sized module. Since the second level shifter in the display panel is composed of p-type thin film transistors, the input multiplexer clock is reliably amplified to the output multiplexer clock, so that the flat panel display device is much improved in the present invention. When the flat panel display device includes a multiplexer, at least one multiplexer clock is used and at least one second level shifter can be formed to amplify the at least one multiplexer clock. Either a liquid crystal display device or an organic electroluminescent display device can be used as the display panel of the flat panel display device in the present invention.

It will be apparent to those skilled in the art that various modifications and variations can be made in the flat panel display device for a small module application of the present invention without departing from the spirit or scope of the inventions. Thus, it is intended that the present invention covers the modifications and variations of this invention provided they come within the scope of the appended claims and their equivalents.

What is claimed is:

1. A flat panel display device having a circuit unit and a display panel, comprising:

a DC/DC converter supplying a DC voltage;

a timing controller connected to the DC/DC converter, the timing controller outputting a gate control signal and a data control signal;

a first level shifter at the circuit unit amplifying the gate control signal and the data control signal from the timing controller;

a second level shifter at the display panel amplifying the gate control signal and the data control signal amplified by the first level shifter;

a plurality of gate lines and data lines crossing one another;

a gate driver connected to a first end of each of the gate lines, the gate driver outputting a scan signal according to the gate control signal amplified by the second level shifter; and a data driver connected to a second end of each of the data lines, the data driver outputting a gray level voltage according to the data control signal amplified by the second level shifter.

2. The device according to claim 1, wherein the gate control signal includes a timing sync signal and the data control signal includes RGB data.

3. The device according to claim 1, wherein the gate driver and the data driver include a gate shift register and a data shift register, respectively.

4. The device according to claim 1, wherein the gate control signal includes a gate clock and the data control signal includes a source pulse clock, wherein the gate clock and the source pulse clock are amplified by the first level shifter to have a first voltage-swing less than about 10 V, and the amplified gate clock and the amplified source pulse clock are amplified by the second level shifter to have a second voltage-swing greater than about 10 V.

5. The device according to claim 4, wherein the second level shifter includes a gate level shifter amplifying the gate clock and a data level shifter amplifying the source pulse clock.

6. The device according to claim 5, wherein the gate level shifter outputs a first pulse having the same waveform as the gate clock and having the second voltage-swing greater than about 10 V, wherein the first pulse is generated by first and second DC voltages with a voltage difference greater than about 10 V transmitted from the DC/DC converter, the amplified gate clock, and a first clock having a waveform inverse to the gate clock.

7. The device according to claim 6, wherein the gate level shifter comprises:

a first thin film transistor having a first gate electrode, a first source electrode, and a first drain electrode, wherein the first gate electrode and the first drain electrode are applied with the first DC voltage;

a second thin film transistor having a second gate electrode, a second source electrode, and a second drain electrode, wherein the second drain electrode is connected to the first source electrode, and the gate clock is applied to the second gate electrode;

a third thin film transistor having a third gate electrode, a third source electrode, and a third drain electrode, wherein the third gate electrode is connected to the second source electrode through a first node, and the third drain electrode is connected to the first source electrode and the second drain electrode;

a fourth thin film transistor having a fourth gate electrode, a fourth source electrode, and a fourth drain electrode, wherein the fourth gate electrode is connected to the third source electrode through a second node, and the fourth drain electrode is applied with the first DC voltage;

a fifth thin film transistor having a fifth gate electrode, a fifth source electrode, and a fifth drain electrode, wherein the fifth drain electrode is connected to the first node, and the fifth gate electrode is applied with the first clock;

a sixth thin film transistor having a sixth gate electrode, a sixth source electrode, and a sixth drain electrode, wherein the sixth drain electrode is connected to the fifth source electrode, the sixth gate electrode is applied with the first clock;

a seventh thin film transistor having a seventh gate electrode, a seventh source electrode, and a seventh drain electrode, wherein the seventh gate electrode is applied with the first clock, the seventh source electrode is applied with the second DC voltage, the seventh source electrode is connected to the sixth source electrode, the seventh drain electrode is connected to the fourth source electrode through a third node, and the third node functions as an output terminal of the gate level shifter;

a first capacitor between the first and second nodes; and a second capacitor between the second and third nodes.

8. The device according to claim 7, wherein the first and second DC voltages are about −8 V and about 10 V, respectively.

9. The device according to claim 8, wherein the first to eighth thin film transistors are formed of n-type polycrystalline silicon.

10. The device according to claim 8, wherein the first to eighth thin film transistors are formed of p-type polycrystalline silicon.

11. The device according to claim 5, wherein the data level shifter outputs a second pulse having the same waveform as the source pulse clock and having the second voltage-swing greater than about 10 V, wherein the second pulse generated by first and second DC voltages with a voltage difference greater than about 10 V transmitted from the DC/DC converter, the amplified source pulse clock, and a second clock having a waveform inverse to the source pulse clock.

12. The device according to claim 11, wherein the data level shifter comprises:

a first thin film transistor having a first gate electrode, a first source electrode, and a first drain electrode, wherein the first gate electrode and the first drain electrode are applied with the first DC voltage;

a second thin film transistor having a second gate electrode, a second source electrode, and a second drain electrode, wherein the second drain electrode is connected to the first source electrode, and the source pulse clock is applied to the second gate electrode;

a third thin film transistor having a third gate electrode, a third source electrode, and a third drain electrode, wherein the third gate electrode is connected to the second source electrode through a first node, and the third drain electrode is connected to the first source electrode and the second drain electrode;

a fourth thin film transistor having a fourth gate electrode, a fourth source electrode, and a fourth drain electrode, wherein the fourth gate electrode is connected to the third source electrode through a second node, and the fourth drain electrode is applied with the first DC voltage;

a fifth thin film transistor having a fifth gate electrode, a fifth source electrode, and a fifth drain electrode, wherein the fifth drain electrode is connected to the first node, and the fifth gate electrode is applied with the second clock;

a sixth thin film transistor having a sixth gate electrode, a sixth source electrode, and a sixth drain electrode, wherein the sixth drain electrode is connected to the fifth source electrode, and the sixth gate electrode is applied with the second clock;

a seventh thin film transistor having a seventh gate electrode, a seventh source electrode, and a seventh drain electrode, wherein the seventh gate electrode is applied with the second clock, the seventh source electrode is applied with the second DC voltage, the seventh source electrode is connected to the sixth source electrode, the seventh drain electrode is connected to the fourth source electrode through a third node, and the third node functions as an output terminal of the gate level shifter;

a first capacitor between the first and second nodes; and a second capacitor between the second and third nodes.

13. The device according to claim 12, wherein the first and second DC voltages are about −8 V and about 10 V, respectively.

14. The device according to claim 13, wherein the first to eighth thin film transistors are formed of n-type polycrystalline silicon.

15. The device according to claim 13, wherein the first to eighth thin film transistors are formed of p-type polycrystalline silicon.

16. The device according to claim 11, wherein the data level shifter comprises a second inverter inverting the amplified source pulse clock to the second clock.

17. The device according to claim 6, wherein the gate level shifter comprises a first inverter inverting the amplified gate clock to the first clock.

18. The device according to claim 1, wherein the timing controller and the first level shifter are formed in a single semiconductor chip.

19. The device according to claim 1, wherein the DC/DC converter is formed on a printed circuit board, the timing controller and the first level shifter is formed on a flexible printed circuit board connecting the printed circuit board and the display panel.

20. The device according to claim 1, further comprising a gate driving voltage generator and a gray level voltage generator connected to the DC/DC converter.

21. A flat panel display device having a circuit unit and a display panel, comprising:

a DC/DC converter supplying a DC voltage;

a timing controller connected to the DC/DC converter, the timing controller outputting a gate control signal, a data control signal, and a multiplexer clock;

a first level shifter at the circuit unit amplifying the gate control signal and the multiplexer clock from the timing controller;

a data driver outputting a gray level voltage according to the data control signal;

a second level shifter at the display panel amplifying the gate control signal and the multiplexer clock;

a plurality of gate lines and data lines crossing one another;

a gate driver connected to a first end of each of the gate lines, the gate driver outputting a scan signal according to the gate control signal amplified by the second level shifter; and a multiplexer connected to the data driver and a second end of each of the data lines, the multiplexer outputting the gray level voltage transmitted from the data driver according to the multiplexer clock amplified by the second level shifter.

22. The device according to claim 21, wherein the gate control signal includes a timing sync signal and the data control signal includes RGB data.

23. The device according to claim 21, wherein the gate driver and the data driver include a gate shift register and a data shift register, respectively.

24. The device according to claim 22, wherein the gate control signal includes a gate clock and the data control signal includes a source pulse clock, wherein the gate clock and the source pulse clock are amplified by the first level shifter to have a first voltage-swing less than about 10 V, and the amplified gate clock and the amplified source pulse clock are amplified by the second level shifter to have a second voltage-swing greater than about 10 V.

25. The device according to claim 24, wherein the second level shifter includes a gate level shifter amplifying the gate clock and a multiplexer level shifter amplifying the multiplexer clock.

26. The device according to claim 25, wherein the gate level shifter outputs a first pulse having the same waveform as the gate clock and having the second voltage-swing greater than about 10 V, wherein the first pulse is generated by first and second DC voltages with a voltage difference greater than about 10 V transmitted from the DC/DC converter, the amplified gate clock first, and a first clock having a waveform inverse to the gate clock.

27. The device according to claim 26, wherein the gate level shifter comprises:

a first thin film transistor having a first gate electrode, a first source electrode, and a first drain electrode, wherein the first gate electrode and the first drain electrode are applied with the first DC voltage;

a second thin film transistor having a second gate electrode, a second source electrode, and a second drain electrode, wherein the second drain electrode is connected to the first source electrode, and the gate clock is applied to the second gate electrode;

a third thin film transistor having a third gate electrode, a third source electrode, and a third drain electrode, wherein the third gate electrode is connected to the second source electrode through a first node, and the third drain electrode is connected to the first source electrode and the second drain electrode;

a fourth thin film transistor having a fourth gate electrode, a fourth source electrode, and a fourth drain electrode, wherein the fourth gate electrode is connected to the third source electrode through a second node, and the fourth drain electrode is applied with the first DC voltage;

a fifth thin film transistor having a fifth gate electrode, a fifth source electrode, and a fifth drain electrode, wherein the fifth drain electrode is connected to the first node, and the fifth gate electrode is applied with the first clock;

a sixth thin film transistor having a sixth gate electrode, a sixth source electrode, and a sixth drain electrode, wherein the sixth drain electrode is connected to the fifth source electrode, and the sixth gate electrode is applied with the first clock;

a seventh thin film transistor having a seventh gate electrode, a seventh source electrode, and a seventh drain electrode, wherein the seventh gate electrode is applied with the first clock, the seventh source electrode is applied with the second DC voltage, the seventh source electrode is connected to the sixth source electrode, the seventh drain electrode is connected to the fourth source electrode through a third node, and the third node functions as an output terminal of the gate level shifter;

a first capacitor between the first and second nodes; and a second capacitor between the second and third nodes.

28. The device according to claim 27, wherein the first and second DC voltages are about −8 V and about 10 V, respectively.

29. The device according to claim 28, wherein the first to eighth thin film transistors are formed of n-type polycrystalline silicon.

30. The device according to claim 28, wherein the first to eighth thin film transistors are formed of p-type polycrystalline silicon.

31. The device according to claim 25, wherein the multiplexer level shifter outputs a second pulse having the same waveform as the multiplexer clock and having the second voltage-swing greater than about 10 V, wherein the second pulse is generated by first and second DC voltages with a voltage difference greater than about 10 V transmitted from the DC/DC converter, the amplified multiplexer clock, and a second clock having a waveform inverse to the multiplexer clock.

32. The device according to claim 31, wherein the multiplexer level shifter comprises:

a first thin film transistor having a first gate electrode, a first source electrode, and a first drain electrode, wherein the first gate electrode and the first drain electrode are applied with the first DC voltage;

a second thin film transistor having a second gate electrode, a second source electrode, and a second drain electrode, wherein the second drain electrode is connected to the first source electrode, and the second gate electrode is applied with the multiplexer clock;

a third thin film transistor having a third gate electrode, a third source electrode, and a third drain electrode, wherein the third gate electrode is connected to the second source electrode through a first node, and the third drain electrode is connected to the first source electrode and the second drain electrode;

a fourth thin film transistor having a fourth gate electrode, a fourth source electrode, and a fourth drain electrode, wherein the fourth gate electrode is connected to the third source electrode through a second node, and the fourth drain electrode is applied to the first DC voltage;

a fifth thin film transistor having a fifth gate electrode, a fifth source electrode, and a fifth drain electrode, wherein the fifth drain electrode is connected to the first node, and the fifth gate electrode is applied with the second clock;

a sixth thin film transistor having a sixth gate electrode, a sixth source electrode, and a sixth drain electrode, wherein the sixth drain electrode is connected to the fifth source electrode, and the sixth gate electrode is applied with the second clock;

a seventh thin film transistor having a seventh gate electrode, a seventh source electrode, and a seventh drain electrode, wherein the seventh gate electrode is applied with the second clock, the seventh source electrode is applied with the second DC voltage, the seventh source electrode is connected to the sixth source electrode, the seventh drain electrode is connected to the fourth source electrode through a third node, and the third node functions as an output terminal of the gate level shifter;

a first capacitor between the first and second nodes; and a second capacitor between the second and third nodes.

33. The device according to claim 32, wherein the first and second DC voltages are about −8 V and about 10 V, respectively.

34. The device according to claim 33, wherein the first to eighth thin film transistors are formed of n-type polycrystalline silicon.

35. The device according to claim 33, wherein the first to eighth thin film transistors are p-type formed of polycrystalline silicon.

36. The device according to claim 31, wherein the multiplexer level shifter comprises a second inverter inverting the amplified multiplexer clock to the second clock.

37. The device according to claim 26, wherein the gate level shifter comprises a first inverter inverting the amplified gate clock to the first clock.

38. The device according to claim 21, wherein the timing controller, the first level shifter, and the data driver are formed in a single semiconductor chip.

39. The device according to claim 21, wherein the DC/DC converter is formed on a printed circuit board, and the timing controller, the first level shifter, and the data driver are formed on a flexible printed circuit board connecting the printed circuit board and the display panel.

40. The device according to claim 21, further comprising a gate driving voltage generator and a gray level voltage generator connected to the DC/DC converter.

41. A gate level shifter of a flat panel display device driven by positive and negative power sources and positive and negative input multiplexer clocks, comprising:

a first switching part receiving the positive input multiplexer clock and the negative power source and outputting a first output voltage;

a second switching part receiving the negative input multiplexer clock and the positive power source and outputting a second output voltage;

a third switching part receiving the first output voltage and outputting a third output voltage; and a fourth switching part receiving the third output voltage and outputting a fourth output voltage substantially the same as the negative power source, wherein an absolute value of the third output voltage is greater than that of the fourth output voltage.

42. A method of driving a gate level shifter of a flat panel display device driven by positive and negative power sources and positive and negative input multiplexer clocks, comprising:

receiving the positive input multiplexer clock and the negative power source at a first switching part and outputting a first output voltage;

receiving the negative input multiplexer clock and the positive power source at a second switching part and outputting a second output voltage;

receiving the first output voltage at a third switching part and outputting a third output voltage; and outputting a fourth output voltage substantially the same as the negative power source at a fourth switching part after receiving the third output voltage, wherein an absolute value of the third output voltage is greater than that of the fourth output voltage.

* * * * *